US005615891A

United States Patent [19]

Pankz

[11] Patent Number: 5,615,891

[45] Date of Patent: Apr. 1, 1997

[54] WATER VOLLEYBALL GAME AND APPARATUS

[76] Inventor: Brian Pankz, 8414 Intrepid La., Rowlett, Tex. 75088

[21] Appl. No.: 657,195

[22] Filed: Jun. 3, 1996

[51] Int. Cl.[6] ..... A63B 71/00

[52] U.S. Cl. ..... 473/492; 473/494

[58] Field of Search ..... 273/411

[56] References Cited

U.S. PATENT DOCUMENTS

| | | | |
|---|---|---|---|
| 2,130,820 | 9/1938 | Trumbull | 273/411 X |
| 2,207,864 | 7/1940 | Hoeltje | 273/411 |
| 3,794,322 | 2/1974 | Rosekrans, Jr. | 273/411 |
| 3,953,029 | 4/1976 | Boyd | 273/411 X |
| 4,307,887 | 12/1981 | Weiss | 273/411 |
| 5,375,849 | 12/1994 | Sabourin | 273/411 |
| 5,499,822 | 3/1996 | Sabourin | 273/411 |

*Primary Examiner*—William H. Grieb
*Attorney, Agent, or Firm*—John P. Halvonik

[57] ABSTRACT

A volley ball support system for playing a game of volley ball in a pool is described. A floatation buoy supports one end of the volleyball net and freely floats in the pool without being anchored to the floor of the pool. The buoy includes a guide in order to attach a line strung to both sides of the pool in order to keep the buoy from moving and a freely held weight that keeps the buoy righted should contestants come in contact with the buoy. The game may use flexible nets that can be adjusted in width simply by rotating the upright supports in order to pick up excess slack or to add slack to the nets.

3 Claims, 2 Drawing Sheets

WATER VOLLEYBALL GAME AND APPARATUS

BACKGROUND AND FIELD OF THE INVENTION

The invention relates to the field of volleyball games and equipment and, in particular, to a novel floatation buoy for supporting one end of a volleyball net in a body of water, such as a swimming pool, without causing danger to the contestants and/or having the net move. In particular, the invention is drawn to a freely movable float that does not require an underwater anchor but rather has a weighted means supported below the water line and is connected to a guide line in order to keep the buoy in place.

It is believed that the use of such a floatation system having the combination of a free floating buoy with a guide line and in connection with a flexible net will allow the users of the game to adjust the length and/or width of the net at any time they so desire by simply reconnecting the guide line. Also it is believed that the use of a freely floating buoy that is not anchored to the bottom of the pool will remove underwater obstructions from the contestants.

PRIOR ART

While there are volleyball games that have nets that are supported by self righting buoys, such as that to Rosenkrans U.S. Pat. No. 3,794,322; none of the prior art is believed to show the use of a guide line in connection with a freely floating buoy. Nor does the prior art show the use of a free floating buoy at one end of the net. By "freely floating" it is meant that the buoy is not in connection with the floor of the pool. The applicant's buoy is still secured by means of a guide line and a weight but does not present and underwater obstacle. Such prior art to Rosenkrans shows an anchor 32 at one end of the net that is designed to prevent the buoy from movement by being anchored to the floor of the pool. Such prior art does not allow the buoy to float free and, hence, poses a danger to contestants as the buoy is fixed in position underwater and cannot move should a contestant come in contact with the underwater obstruction.

Most such volleyball systems on the market today do not have a provision to allow the net to be drawn across the pool in such manner as to insure that both teams will be in the same depth of water. As most pools slope in one direction or the other, it becomes necessary with prior art system to draw the net across the length of the pool. Typical pool lengths are 40 feet or more and this makes in impossible to stretch the length in that direction. The use of the floating buoy and flexible net allow the applicant's invention to be drawn lengthwise but the use of the floating buoy eliminates the need to stretch the net across the entire length of the pool.

Moreover, such prior art requires a rigid net to be used in connection with buoy in order to maintain the net and support structure across the pool in a direction perpendicular to the edges of the pool. The use of such a rigid frame for the net does not allow the width of the net to be adjusted as needed. Nor does such prior art show the use of a flexible net in connection with such buoy. The applicant's invention can use a flexible net-where the upper edge of the net is flexible so that it can simply be rolled up by rotating the upright supports to pick up excess slack. Or can be extended in width by rotating supports to add extra width to the net. By "width" it is meant that distance from the one sideline to the other in the volleyball game. By "height" is meant the height above the water that the top edge of the volleyball net is at.

The combination of the applicant's guide line and a flexible net allows the volley ball net to be adjusted as needed without having to tamper with or otherwise make corrections to the float. The prior art shows nets that have a rigid frame and are necessarily of a fixed width and height. Such prior art volley ball games would have to have the entire apparatus replaced if a net of a different width or height is desired to be used.

SUMMARY OF THE INVENTION

The invention is a system and an apparatus for playing a game of volley ball in a body of water. Typically the body of water would be a swimming pool and the apparatus comprises a buoy constructed as a floatable apparatus so that there will be an upper surface above the water line and a lower surface beneath the waterline. There is a vertical support extending upward from the upper surface of the buoy and is used to support the net and frame strung across the pool. The buoy has a line descending from the under surface of the buoy and in connection with a weighted means in order to right the buoy should it be contacted. There is an attachment means for a guide line on the upper surface of the buoy that allows for connection of a guide line to the buoy. Such guide line should be in connection with one or both ends of the pool and will be able to keep the buoy in position without altering the length of the net. The buoy will be able to move should a contestant encounter it but will then return to place by virtue of the guide line and weight. The users of the game may use flexible nets that can be adjusted in width simply by rotating the upright supports in order to pick up excess slack or to add slack to the nets.

It is among the objects of the invention to provide a volley ball net support apparatus for floating upon a body of water in a fixed position without causing danger to the contestants.

Another objective is to provide a volley ball net support apparatus for floating upon a body of water that floats freely upon the surface of the water and so be able to move when the ball and/or contestants encounter such buoy.

Another objective is to provide a volley ball net support apparatus for freely floating upon a body of water and so be able to be moved about the pool when it is desired to change the width of the net in connection with such buoy.

Other objectives of the invention will be readily apparent to those skilled in the art once the invention has been described.

DESCRIPTION OF THE PREFERRED EMBODIMENT

Figure 1:
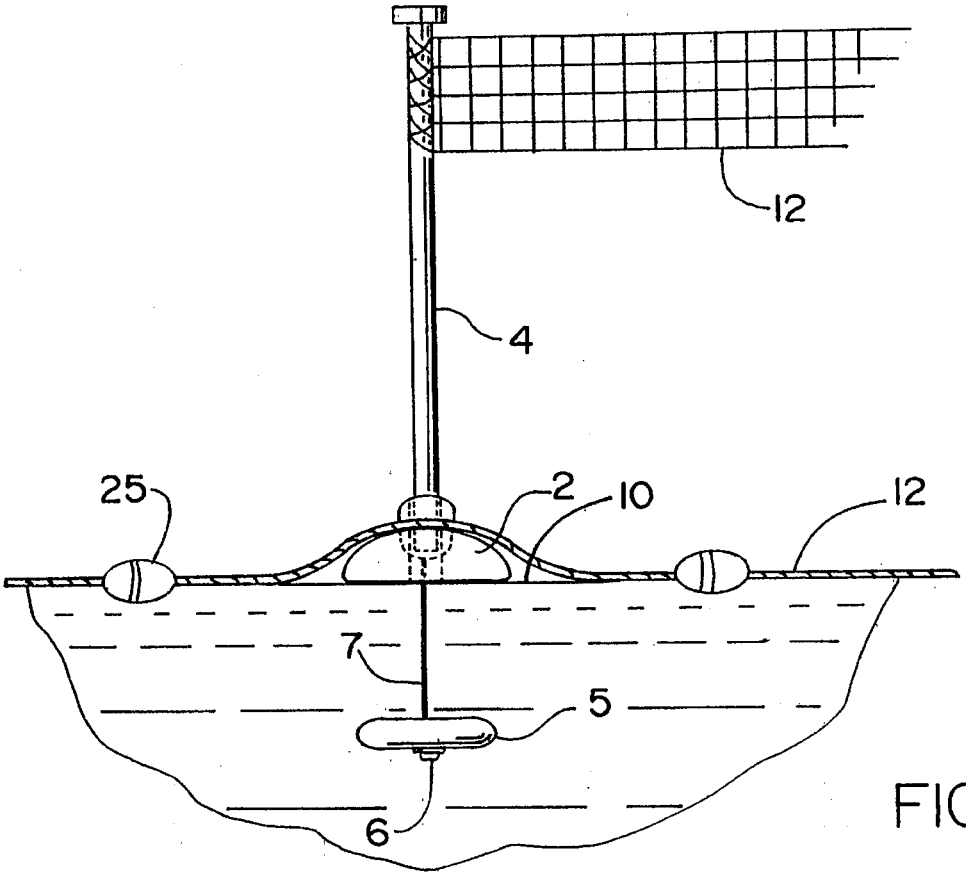
FIG. 1 Overall set up of the system.
Figure 2:
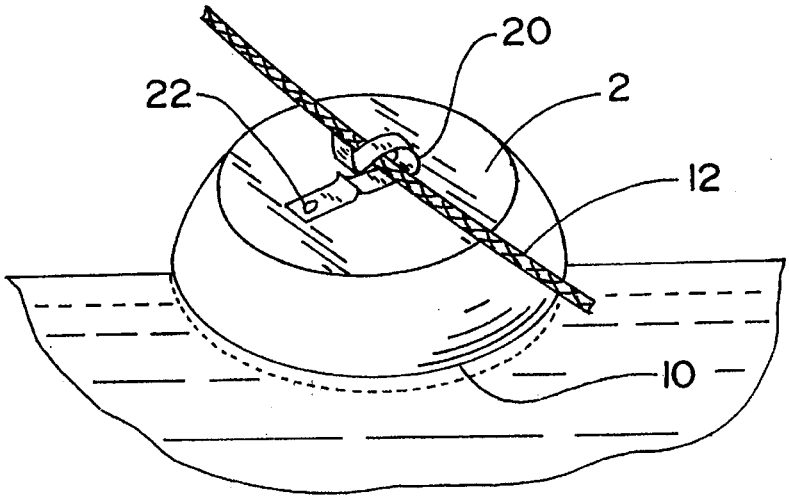
FIG. 2 Detail of guide line on the buoy.
Figure 3:
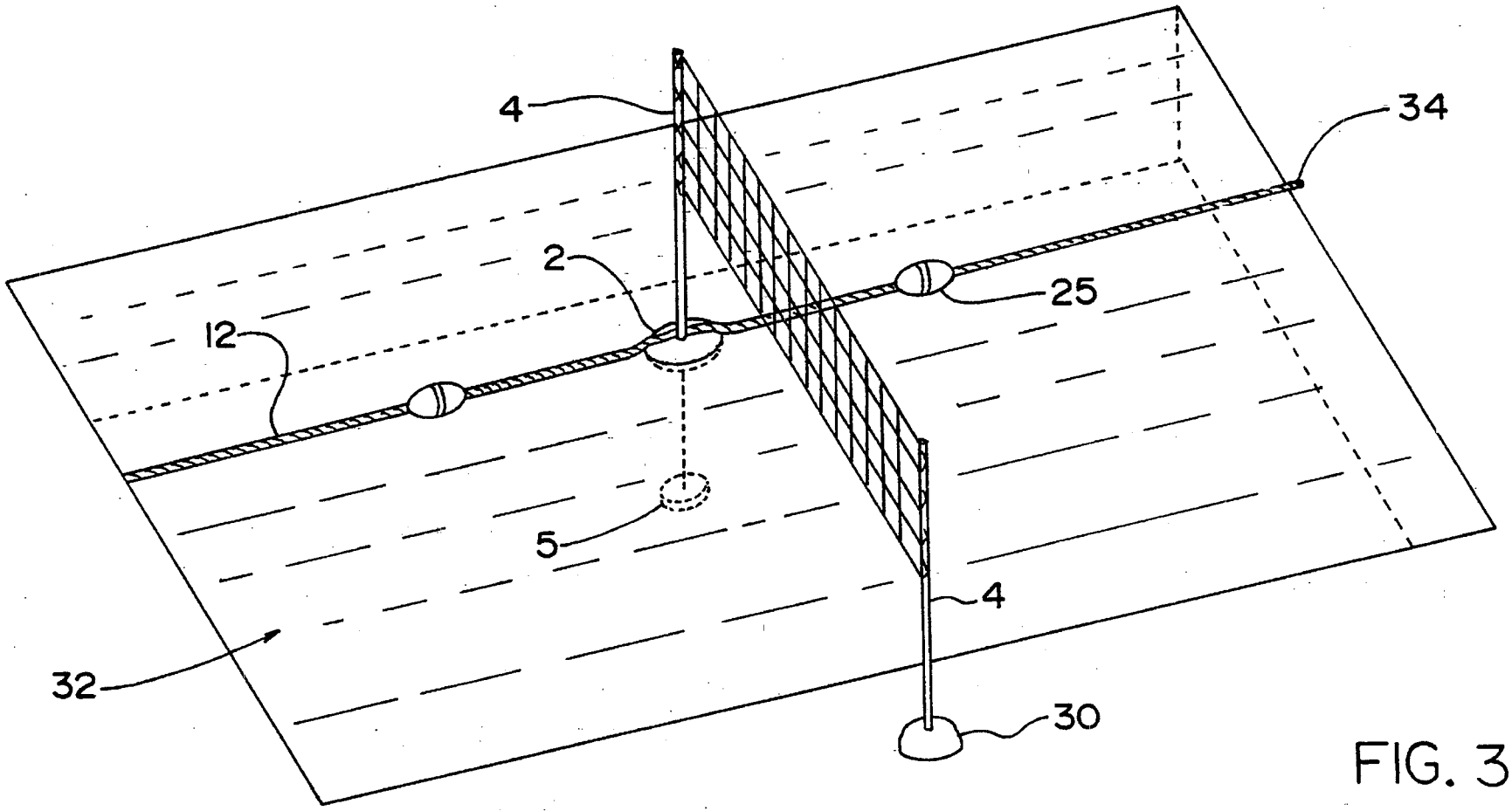
FIG. 3 system in use in a pool.

The float is shown in detail in FIG. 1. There is shown and described a net 12 having a pair of upright supports 4 in order to support the net at a distance above the level of water in the pool 32, see FIG. 3. It is preferred that one of the net supports 30 be outside the pool on the deck and the other support or buoy 2 should float in the water, in is described herein.

The buoy should be constructed so that it will float on the water and it is preferred that the buoy be of hollow construction. Preferred materials for the buoy include plastic or other lightweight materials. The buoy will thus have a water line and may be said to have an underside below the water line and an upper surface above the water line.

There is an upright support 4 in connection with the upper surface of the buoy and should be of height sufficient to support one end of the volleyball net.

There is a line 7 attached to the under surface of the buoy and having a weight 5 at the end. The weighted line should be constructed so that the weight does not extend to the floor of the pool or otherwise present an underwater obstruction lying on the bottom of the pool. The line may be attached by a washer 6 at the end of the line that keeps the weight from moving off the line.

The guide or clip 20 is shown on the upper surface of the buoy and should be able to releasably secure a guide line 12 strung across the pool, as shown. The ends of the line may be attached to opposite walls of the pool at 34. The guide consists of a curved piece of plastic 20 in connection with a base 2 of similar material. The base may include holes or other means such as a bolt similar park 22 for attaching the base to the buoy. The curved piece of plastic should curve back onto itself so as to present an opening for placing the guide line through the guide. The plastic should be resilient enough so that the curved portion can be bent apart with some pressure in order to release the line from the guide should that be necessary e.g. in the case where the users decide to change the width of the net and the position of the buoy will thus need to be changed.

The use of the guide line in connection with the freely floating buoy maintains the buoy in its overall position in the water. The system shown here dispenses with the need for a rigid underwater support on the floor of the pool and so eliminates a potential danger to the players.

The freely floating buoy can be adjusted to accommodate different changes in the width of the net merely be removing the guide line from the floating buoy and then moving the buoy to a different position in the water. As the distance between the supports 4 is increased, the width of the net may accommodate this change by simply rotating the supports to allow more net to play out. By the same token, if the distance between the supports is decreased, the width of the net can be decreased by rotating the supports to pick up the extra slack in the net. Such prior art does not allow for such a simple adjustment.

I claim:

1. A system for supporting a volleyball net across a body of water comprising: a floatation device for floating upon the body of water so as to present a water line across said floatation device and said floatation device having an upper surface above said water line and an under surface below said water line, said floatation device in connection with a vertically oriented support said support in connection with one end of the net, a second support in connection with the other side of said net, said floatation device having a means for securing a line upon said upper surface of said floatation device, said floatation device having a weighted means in connection with an underwater line, said underwater line in connection with said underside of said float, said line of suitable length so that said weighted means does not contact the floor of said pool, said weighted means of sufficient weight to maintain the orientation of said floatation means upon said body of water, and said guide line secured to at least one point outside of said body of water in order to secure said floatation device and said net upon the body of water in a fixed position.

2. The apparatus of claim 1 wherein said net has a flexible line across the top of said net and said net hangs down from said flexible line in connection with each of said supports.

3. The apparatus of claim 2 wherein said guide comprises a resilient clip having a double construction so as to create an opening for said line, said clip of sufficient resiliency so as to be able to be bent apart in order to release said line from said floatation device.

* * * * *